US005520204A

United States Patent [19]

Bodis

[11] Patent Number: 5,520,204

[45] Date of Patent: May 28, 1996

[54] VAPOR DEGREASING APPARATUS

[75] Inventor: Alfred K. Bodis, Huntington, Conn.

[73] Assignee: Branson Ultrasonics Corporation, Danbury, Conn.

[21] Appl. No.: 378,640

[22] Filed: Jan. 26, 1995

[51] Int. Cl.[6] ..... B08B 3/10

[52] U.S. Cl. ..... 134/61; 134/108; 202/170

[58] Field of Search ..... 134/61, 105, 107, 134/108, 109; 202/170

[56] References Cited

U.S. PATENT DOCUMENTS

| | | | |
|---|---|---|---|
| 3,229,702 | 1/1966 | Murdoch, Jr. | 134/109 X |
| 4,690,158 | 9/1987 | Yamada et al. | 134/107 |
| 5,085,238 | 2/1992 | Baldwin | 134/105 |
| 5,241,976 | 9/1993 | Ikawa | 134/108 X |
| 5,360,027 | 11/1994 | Harman | 202/170 X |

FOREIGN PATENT DOCUMENTS

| | | | |
|---|---|---|---|
| 2158465 | 11/1985 | United Kingdom | 134/105 |

*Primary Examiner*—Philip R. Coe
*Attorney, Agent, or Firm*—Polster, Lieder, Woodruff & Lucchesi

[57] ABSTRACT

A vapor degreasing apparatus includes a heated surface which is heated to a temperature above the boiling point temperature of the solvent used, but below the breakdown temperature of the solvent. The surface is disposed in the solvent vapor area provided above the customary immersion sump containing solvent in its liquid state. After a workpiece has been immersed and cleaned in the liquid solvent, the workpiece is exposed to the heated surface for becoming heated to a temperature which is above the boiling point of the solvent, thereby causing liquid solvent adhering to surfaces of the workpiece to be vaporized and enter the surrounding vapor atmosphere. As the workpiece subsequently is withdrawn from the apparatus, no further solvent adheres to the workpiece and it enters the ambient atmosphere free of any solvent. The apparatus, therefore, provides for substantially zero vapor contamination of the ambient atmosphere.

6 Claims, 1 Drawing Sheet

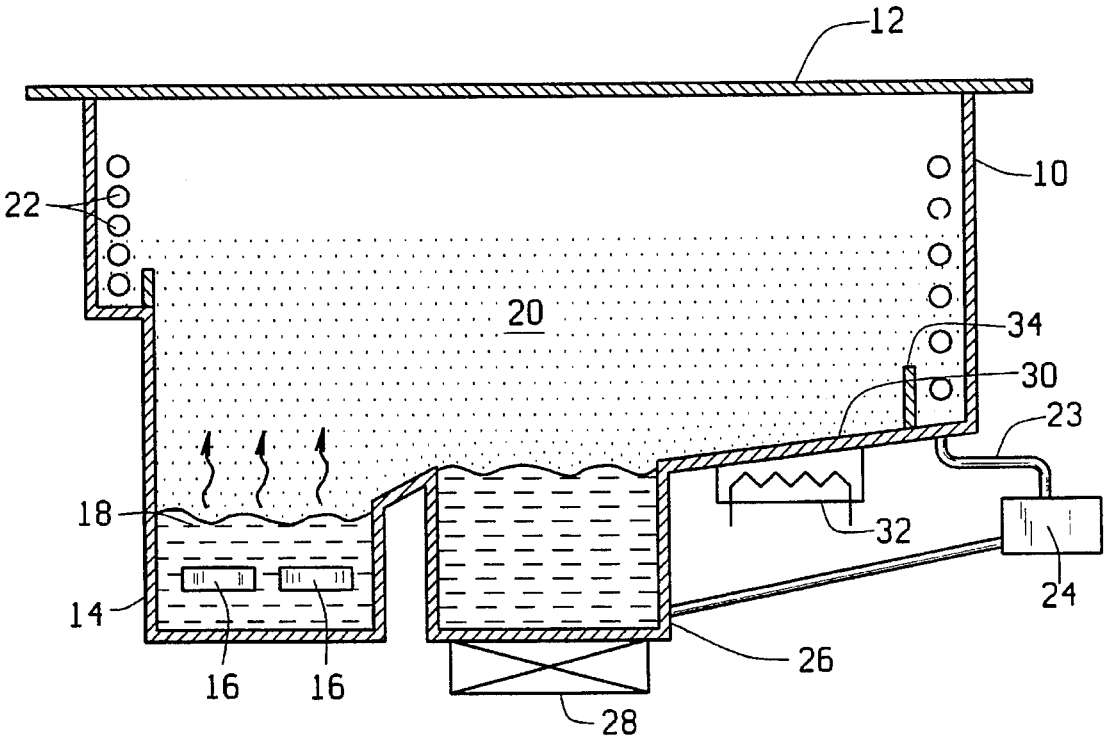
12
10
22
20
34
30
23
18
32
24
14
26
16
16
28

VAPOR DEGREASING APPARATUS

SUMMARY OF THE INVENTION

This invention relates to vapor degreasing apparatus used for cleaning and degreasing workpieces by the use of suitable solvents in their liquid and vapor phase state and, more specifically, concerns vapor degreasing apparatus in which the loss of solvent to ambient is minimized. The loss of solvent material in a vapor degreasing apparatus arises primarily from two sources, namely the escape of solvent vapor when the apparatus cover is removed during cleaning of workpieces, and the adherence of liquid solvent to the workpiece surface as such workpiece, after having been cleaned, is removed from the apparatus to the ambient atmosphere, such loss being commonly identified as drag-out loss. The escape of solvent vapor is prevented largely by the presence of a vapor condensing area disposed directly above the solvent vapor zone. The condensing area condenses the solvent vapor which is then returned via a water separator to a sump at the bottom of the apparatus. The loss of solvent, of course, entails a monetary loss, but more significantly contributes to a contamination of the ambient atmosphere, a condition which no longer is acceptable.

Several arrangements have been described to further reduce and minimize the loss of solvent. One arrangement includes the provision of additional cooling means in the condensing area above the vapor zone of the apparatus in order to further minimize the escape of solvent vapor.

An arrangement for reducing the drag-out loss has been disclosed in U.S. Pat. No. 5,085,238 entitled "Vapor Degreasing Apparatus" issued to R. S. Baldwin, dated Feb. 4, 1992. This patent describes the provision of additional heating means disposed for causing vaporized solvent generated in a boiling sump to be brought to a superheated state as the solvent flows from the boiling sump toward the vapor zone through which a workpiece traverses along its path into and out of the apparatus. As the workpiece is withdrawn from the apparatus to the ambient atmosphere, the workpiece becomes exposed to the superheated vapor and attains a temperature which minimizes the adherence of solvent.

The present invention provides a further solution for reducing the adherence of solvent to the workpiece surface just prior to the removal of the cleaned workpiece from the apparatus. The apparatus includes a heated surface disposed in the vapor zone, and workpieces to be removed from the apparatus after cleaning are brought into contact with the heated surface for becoming heated to a temperature which is above the boiling point temperature of the solvent. The elevated temperature of the workpiece will assure that substantially no solvent remains in the cavities and crevices of the workpiece and that no solvent from the vapor zone will deposit on the workpiece surface as the workpiece is withdrawn from the apparatus. Thus, the workpiece is removed from the degreasing apparatus free of any solvent.

One of the principal objects of this invention is the provision of a new and improved vapor degreasing apparatus.

Another important object of this invention is the provision of a new and improved vapor degreasing apparatus in which the loss of solvent is minimized.

Another important object of this invention is the provision of a vapor degreasing apparatus including means for causing cleaned workpieces to attain a temperature which is above that of the boiling point temperature of the solvent used in the apparatus.

A further important object of this invention is the provision of a vapor degreasing apparatus which is provided in the solvent vapor zone of the apparatus with a heated surface for receiving thereupon workpieces which by contact with such surface attain a temperature which is above that of the boiling point temperature of the surrounding solvent vapor, whereby the workpieces upon removal from the apparatus to the ambient atmosphere are substantially free of solvent.

Still further and other important objects of this invention will become more clearly apparent from the following description when taken in conjunction with the accompanying drawing.

BRIEF DESCRIPTION OF THE DRAWING

The single FIGURE is a schematic elevational view, partly in section, of the new and improved vapor degreasing apparatus.

DETAILED DESCRIPTION

Referring now to the FIGURE, numeral 10 denotes the stainless steel enclosure of the vapor degreasing apparatus which is provided with a removable lid or cover 12. As is quite conventional, there is present a first boiling sump chamber 14 in which heating means 16 cause liquid solvent to be changed to its vapor state. A second chamber 20, disposed above the boiling sump and in communication with the boiling sump, comprises a vapor zone area into which the solvent vapor from the boiling sump flows responsive to natural convection. The second chamber 20 includes peripherally disposed condensing coils 22 above the vapor zone area for condensing the solvent which is collected in a trough 34, shown schematically, and returned via suitable piping 23 and a water separator 24 to a third chamber 26, generally known as a liquid or immersion sump, disposed below the vapor zone area and adjacent to the boiling sump 14. The sump 26, optionally, includes ultrasonic transducer means 28 for causing cavitation in the liquid solvent when a workpiece is immerrsed therein. As the sump 26 fills with liquid solvent, its overflow passes over a weir and replenishes the boiling sump, thus restarting the cycle.

The degreasing apparatus normally includes, but not shown, a circulating pump with filter for removing contaminants from the solvent.

A workpiece to be cleaned and degreased is held first in the vapor zone area 20 for being wetted and receiving a pre-rinse, is then immersed in the immersion sump 26 for a rinse and intensive cleaning responsive to ultrasonic energy provided by the transducer means 28, is then returned to the vapor zone area 20 for receiving a post-rinse, and subsequently is returned to the ambient atmosphere. As the workpiece is returned to ambient, a certain amount of liquid solvent adheres to its surface despite the presence of the vapor condensing area disposed above the vapor zone through which the workpiece passed.

Generally, cleaning is accomplished on a batch basis, i.e. a plurality of workpieces are disposed in a perforated, open stainless steel basket and the basket is moved through the various stages of treatment.

In the present invention, the vapor degreasing apparatus includes a flat, heated surface 30, which forms a part of the degreasing apparatus enclosure 10 and which is heated by suitable heating means 32, such as electrical heating means, to a temperature which is above the boiling point temperature of the solvent used, but is below the critical breakdown temperature of the solvent. Workpieces or the basket in which workpieces are confined, after immersion in the liquid sump 26, are placed upon the heated surface 30, or distanced just above the surface in the event that heat sensitive workpieces, e.g. plastic parts, are cleaned, whereby the workpieces first reach a temperature substantially equal to that of the solvent boiling point, and then attain a temperature in excess of the solvent boiling point, thereby causing entrapped solvent to vaporize and become a part of the surrounding vapor atmosphere. The now elevated temperature of the workpieces assures that no solvent remains in hidden cavities or crevices and that no vapor from the surrounding vapor zone area deposits itself on the workpieces as the workpieces are lifted from the heated surface 30 through the surrounding vapor zone area out of the enclosure 10. Workpieces reaching the ambient atmosphere, therefore, are free of solvent residue.

The instant arrangement is highly efficient because the workpiece is heated quickly, preferably by conduction, from the metal surface 30 and any basket surface which may be interposed. The temperature difference between the workpiece and the surrounding vapor is readily obtained since the heat transfer from the surface 30 to a workpiece is primarily heat conduction, while the heat transfer from the plate to the surrounding vapor atmosphere is the less effective heat convection.

As illustrated, the heated surface 30 forms a part of the enclosure 10 adjacent to the immersion sump , and is inclined to convey liquid solvent toward the sump.

In an alternative embodiment, the substantially horizontally disposed heated surface 30 can be provided as a separate structure, but still disposed in the vapor zone area of the apparatus and in proximity to the immersion sump for exposing the workpieces to heat after the immersion of the workpieces in the liquid solvent of the immersion sump.

Typical solvents suitable and their boiling point temperatures are as follows:

| Solvent | Approx. B.P. °C. |
|---|---|
| Perfluorocarbons (PFCs) | 57–60 |
| Hydrofluorocarbons (HFCs) | 54.5 |
| Trichloroephylene (TCE) | 82 |

It shall be understood that the solvents listed are merely examples of solvents and no limitation shall be implied.

The surface 30, typically, is heated substantially at 3 watts per $cm^2$. A workpiece is withdrawn from exposure to the heated surface when, as observed visually, condensation of solvent on the workpiece ceases, thus indicating that the workpiece has attained a temperature equal to or exceeding the boiling point temperature of the solvent.

It will be evident that the described arrangement of a heated surface and its temperature condition suited for heating workpieces after immersion in the liquid solvent to a temperature exceeding the boiling point temperature of the solvent constitutes a significant advance toward the goal of providing a zero emission vapor degreasing apparatus.

While there has been described and illustrated a preferred embodiment of the invention, it will be apparent to those skilled in the art that various changes and modifications may be made without departing, however, from the broad principle of this invention, which shall be limited only by the scope of the appended claims.

What is claimed is:

1. In a vapor degreasing apparatus for cleaning workpieces, said apparatus comprising the combination of an enclosure housing a first chamber comprising a boiling sump which includes a first heating means for raising the temperature of a liquid solvent contained therein to its boiling point for providing solvent in its vapor state; a second chamber disposed in said enclosure and communicating with said first chamber for receiving the solvent in its vapor state in a vapor zone area, and including condensing means disposed in said vapor zone area for condensing the solvent; a third chamber disposed in said enclosure comprising an immersion sump disposed for receiving the liquid state solvent from said condensing means and including means for returning liquid solvent overflow to said boiling sump, the improvement comprising: a surface upon which said workpieces are receive& and second heating means in heat transfer relation with said surface for heating said workpieces received thereon to a temperature above the boiling point temperature of the solvent.

2. In a vapor degreasing apparatus as set forth in claim 1, said surface and said workpieces received thereon being heated to said temperature by heat conduction.

3. In a vapor degreasing apparatus as set forth in claim 1, said surface forming a part of said enclosure.

4. In a vapor degreasing apparatus as set forth in claim 1, said heating means comprising electrical means.

5. In a vapor degreasing apparatus as set forth in claim 1, said surface being disposed adjacent to and above said immersion sump.

6. In a vapor degreasing apparatus the combination of an enclosure housing a first chamber comprising a boiling sump which includes a first heating means for raising the temperature of a liquid solvent contained therein to its boiling point for providing solvent in its vapor state; a second chamber disposed in said enclosure and communicating with said first chamber for receiving the solvent in its vapor state in a vapor zone area, and including condensing means disposed in said vapor zone area for condensing the solvent; a third chamber disposed in said enclosure comprising an immersion sump disposed in said enclosure for receiving the liquid state solvent from said condensing means and including means for returning liquid solvent overflow to said boiling sump, the improvement comprising: a surface within said vapor zone area adapted to receive workpieces to be cleaned, said surface being disposed adjacent to and above said immersion sump, and second heating means for heating said surface and said workpieces received by said surface to a temperature above the boiling point temperature of the solvent, said surface being a substantially horizontally disposed surface inclined toward said immersion sump for conveying liquid solvent toward said immersion sump.

* * * * *